US005278019A

United States Patent [19]

Ciccarelli et al.

[11] Patent Number: 5,278,019

[45] Date of Patent: Jan. 11, 1994

[54] PASSIVATED GREEN TONER COMPOSITION

[75] Inventors: Roger N. Ciccarelli, Rochester; Denise R. Bayley, Fairport, both of N.Y.

[73] Assignee: Xerox Corporation, Stamford, Conn.

[21] Appl. No.: 6,429

[22] Filed: Jan. 21, 1993

Related U.S. Application Data

[62] Division of Ser. No. 706,477, May 28, 1991, Pat. No. 5,212,036.

[51] Int. Cl.[5] ..... G03G 9/097

[52] U.S. Cl. ..... 430/110; 430/106; 430/106.6; 430/109; 430/45

[58] Field of Search ..... 430/110, 106, 106.6, 430/109, 45

[56] References Cited

U.S. PATENT DOCUMENTS

| | | | |
|---|---|---|---|
| 4,767,688 | 8/1988 | Hashimoto et al. | 430/110 |
| 4,888,263 | 12/1989 | Tomita et al. | 430/106 |
| 4,965,158 | 10/1990 | Gruber et al. | 430/106.6 |
| 5,075,185 | 12/1991 | Bertrand et al. | 430/45 |
| 5,087,538 | 2/1992 | Nelson | 430/45 |

FOREIGN PATENT DOCUMENTS

| | | |
|---|---|---|
| 914702 | 1/1963 | United Kingdom . |
| 2238395 | 5/1991 | United Kingdom . |

*Primary Examiner*—Marion E. McCamish
*Assistant Examiner*—Rosemary Ashton
*Attorney, Agent, or Firm*—Eugene O. Palazzo; John L. Haack

[57] ABSTRACT

A green toner comprised of resin particles, HELIOGEN GREEN TM pigment particles, a charge enhancing additive, and surface additive particles.

8 Claims, No Drawings

PASSIVATED GREEN TONER COMPOSITION

This is a division of application Ser. No. 07/706,477, now U.S. Pat. No. 5,212,036 filed May 28, 1991, the disclosure of which is incorporated herein by reference in its entirety.

BACKGROUND OF THE INVENTION

The present invention is generally directed to toners, developers, and imaging processes, including a process for forming multicolor, including two-color, images, and more specifically, the present invention is directed to a process for obtaining two-color images which in an embodiment comprises charging an imaging member, creating on the member a latent image comprising areas of high, medium, and low potential, developing the low areas of potential with a developer composition, subsequently developing the high areas of potential with a developer composition, transferring the developed image to a substrate, and optionally permanently affixing the image to the substrate. Another embodiment of the present invention relates to processes for obtaining passivated green toners, and more specifically wherein the green toner pigments are passivated thereby decreasing, or substantially eliminating their adverse effects on the electrical characteristics of the toner and developer compositions containing such pigments. The toner in embodiments can be comprised of resin particles, a green, such as HELIOGEN GREEN TM, negatively charged pigment, and a positive charge enhancing additive, such as distearyl dimethylammonium methyl sulfate; and wherein the pigment selected is passivated. Passivation is achieved by, for example, the admixing of certain colored green pigments and charge additives with the toner resin particles. Advantages associated with the processes of the present invention are the ability to generate high quality two-color images, one of which is green, in a single development pass, particularly as a result of the absence of interaction between the colored, excluding black, and especially green, and the black developers; and passivation of the toner pigments in embodiments of the present invention. Also associated with the processes of the present invention is the ability to generate high quality two-color images, one of which is green, in a single development pass, particularly as a result of the absence of interaction between the green and the black developers in an embodiment of the present invention. Other advantages associated with the present invention include the provision of a developer with stable negative triboelectical toner characteristics and stable negative triboelectrically charged toner which enables the generation of high quality images subsequent to development, that is images with substantially no background deposits and substantially no smearing for a broad range of relative humidity conditions, that is, for example, from 20 to 90 percent relative humidity at an effective range of temperature zones ranging, for example, from about 20° C. to about 80° C.

Toner compositions with colored pigments are known, for example, there is disclosed in U.S. Pat. No. 4,948,686, the disclosure of which is totally incorporated herein by reference, processes for the formation of two color images with a colored developer comprised of a first toner comprised of certain resin particles, such as styrene butadiene, a first pigment, such as copper phthalocyanine, a charge control additive, colloidal silica and metal salts of fatty acid external surface additives, and a first carrier comprised of a steel core with, for example, a polymethyl methacrylate overcoating containing conductive particles therein, or thereon; and a second developer comprised of a black toner, a second charge additive and a steel core carrier with certain polymeric overcoatings. Examples of colored toner pigments are illustrated in column 9, lines 10 to 26, with a specific green not being listed, (note Example VI discloses a green obtained by blending cyan and yellow, which green is not as brilliant or sharp as the green of the present invention) and examples of charge additives for the toner are detailed in column 9, lines 27 to 43, of the aforementioned patent. For the black toner, there can be selected the components as recited in columns 10 and 11, including charge additives such as distearyl dimethyl ammonium methyl sulfate, see column 11, lines 16 to 32. Additionally, the working Examples of this patent detail the preparation of a number of specific toners. More specifically, there is illustrated in the U.S. Pat. No. 4,948,686 patent a process for forming two-color images which comprises, for example, (1) charging an imaging member in an imaging apparatus; (2) creating on the member a latent image comprising areas of high, intermediate, and low potential; (3) developing the low areas of potential by conductive magnetic brush development with a developer comprising a colored first toner comprising a first resin present in an amount of from about 80 to about 98.8 percent by weight and selected from the group consisting of polyesters, styrene-butadiene polymers, styrene-acrylate polymers, styrene-methacrylate polymers, and mixtures thereof; a first pigment present in an amount of from about 1 to about 15 percent by weight and selected from the group consisting of blue copper phthalocyanine pigments, quinacridone pigments, azo pigments, rhodamine pigments, and mixtures thereof; a charge control agent present in an amount of from about 0.2 to about 5 percent by weight; colloidal silica surface external additives present in an amount of from about 0.1 to about 2 percent by weight; and external additives comprising metal salts or metal salts of fatty acids present in an amount of from about 0.1 to about 2 percent by weight; and a first carrier comprising a steel core with an average diameter of from about 25 to about 215 microns and a coating selected from the group consisting of methyl terpolymer, polymethyl methacrylate, and a blend of from about 35 to about 65 percent by weight of polymethyl methacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier; (4) subsequently developing the high areas of potential by conductive magnetic brush development with a developer comprising a black second toner comprising a second resin present in an amount of from about 80 to about 98.8 percent by weight and selected from the group consisting of polyesters, sytrene-butadiene polymers, styrene-acrylate polymers, styrene-methácrylate polymers, and mixtures thereof; a second pigment present in an amount of from about 1 to about 15 percent by weight; and a second charge control additive present in an amount of from about 0.1 to about 6 percent by weight; and a second carrier comprising a steel core with an average diameter of from about 25 to about 215 microns and a coating selected from the group consisting of chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed two-color image to a substrate. Imaging members suitable for use with the process of the aforementioned patent may be of any type capable of maintaining three distinct levels of potential. Generally, various dielectric or photoconductive insulating material suitable for use in xerographic, ionographic, or other electrophotographic processes may be selected for the above process, and suitable photoreceptor materials include amorphous silicon, layered organic materials as disclosed in U.S. Pat. No. 4,265,990, the disclosure of which is totally incorporated herein by reference, and the like.

Processes for obtaining electrophotographic, including xerographic, and two-colored images are known. In U.S. Pat. No. 4,264,185, the disclosure of which is totally incorporated herein by reference, there is illustrated an apparatus for forming two-color images by forming a bipolar electrostatic image of a two-color original document on a photoconductive drum. A first developing unit applies a toner of a first color and polarity to the drum and a second developing unit applies a toner of a second color and polarity to the drum to form a two-color electrostatic image which is transferred and fixed to a copy sheet. A bias voltage of the first polarity is applied to the second developing unit to repel the toner of the first color and prevent degradation of the first color toner image. A bias voltage of the second polarity is applied to the first developing unit to prevent contamination of the first color toner with the second color toner.

In U.S. Pat. No. 4,308,821, there is disclosed a method and apparatus for forming two-color images which employs two magnetic brushes. The first developed image is not substantially disturbed during development of the second image since the second magentic brush contacts the surface of the imaging member more lightly than the first magnetic brush, and the toner scraping force of the second magnetic brush is reduced in comparison with that of the first magnetic brush by setting the magnetic flux density on a second nonmagnetic sleeve with an internally disposed magnet smaller than the magnetic flux density on a first magnetic sleeve, or by adjusting the distance between the second nonmagnetic sleeve and the surface of the imaging member. In addition, the toners selected may have different quantities of electric charge.

Additionally, U.S. Pat. No. 4,378,415, the disclosure of which is totally incorporated herein by reference, illustrates a method of highlight color imaging which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively charged toner components and carrier particles. In U.S. Pat. No. 4,430,402, there is illustrated a two-component type dry developer for use in dichromatic electrophotography which comprises two kinds of developers, each of which is comprised of a toner and a carrier. Dichromatic images are formed by developing a both positively and negatively electrified electrostatic latent image successively with toners different in polarity and color from each other, wherein one carrier becomes positively charged by friction with either of the two toners while the other carrier becomes negatively charged by friction with either of the two toners.

Moreover, U.S. Pat. No. 4,594,302 discloses a developing process for two-colored electrophotography which comprises charging the surface of a photoreceptor with two photosensitive layers of different spectral sensitivities with one polarity, subsequently charging the photoreceptor with a different polarity, exposing a two-colored original to form electrostatic latent images having different polarities corresponding to the two-colored original, developing one latent image with a first color toner of one polarity, exposing the photoreceptor to eliminate electric charges with the same polarity as the first color toner which are induced on the surface of the photoreceptor in the vicinity of the latent image developed by the first color toner, and developing the other latent image with a second color toner charged with a polarity different from that of the first color toner.

In addition, U.S. Pat. No. 4,500,616 discloses a method of developing electrostatic latent images by selectively extracting colored grains of one polarity from a mixture containing colored grains having opposite polarity to each other in the presence of an alternating field, followed by development of the electrostatic image by the selectively extracted colored grains. Also, U.S. Pat. No. 4,524,117 discloses an electrophotographic method for forming two-colored images which comprises uniformly charging the surface of a photoreceptor having a conductive surface and a photoconductive layer sensitive to a first color formed on the conductive substance, followed by exposing a two-colored original to form on the photoconductive layer a latent image corresponding to a second color region in the original with the same polarity as the electric charges on the surface of the photoconductive layer. The photoreceptor surface is then subjected to a reversal development treatment by the use of a photoconductive color toner charged with the same polarity as the electric charges constituting the latent image to develop the noncharged region with the photoconductive toner. The latent image is then subjected to normal development treatment with an insulative toner having a color different from the color of the photoconductive toner. Subsequently, the color toners on the photoconductive layer are charged with a different polarity from the charging polarity and, simultaneously, the original is exposed through a filter shielding against the first color, thereby forming a two-colored image.

Furthermore, in U.S. Pat. No. 4,525,447, the disclosure of which is totally incorporated herein by reference, there is illustrated an image forming method which comprises forming on a photosensitive member an electrostatic latent image having at least three different levels of potentials, or comprising first and second latent images and developing the first and second latent images with a three component developer. The developer comprises a magnetic carrier, a first toner chargeable to one polarity by contact with the magnetic carrier, and a second toner chargeable to a polarity opposite to that of the first toner by contact with the first toner, but substantially not chargeable by contact with the magnetic carrier. Also, U.S. Pat. No. 4,539,281 discloses a method of forming dichromatic copy images by forming an electrostatic latent image having a first image portion and a second image portion. The first image is developed by a first magnetic brush with a magnetic toner of a first color that is chargeable to a specific polarity, and the second image portion is developed by a second magnetic brush with a mixture of a magnetic carrier substantially not chargeable with the magnetic toner and a nonmagnetic toner of a second color chargeable to a polarity opposite to that of the magnetic toner by contact with the magnetic carrier.

Additionally, U.S. Pat. No. 4,562,129, the disclosure of which is totally incorporated herein by reference, illustrates a method of forming dichromatic copy images with a developer composed of a high-resistivity magnetic carrier and a nonmagnetic insulating toner, which are triboelectrically chargeable. An electrostatic latent image having at least three different levels of potential is formed and the toner and carrier are adhered, respectively, onto the first and second image portions. In addition, U.S. Pat. No. 4,640,883, the disclosure of which is totally incorporated herein by reference, illustrates a method of forming composite or dichromatic images which comprises forming on an imaging member electrostatic latent images having at least three different potential levels, the first and second latent images being represented, respectively, by a first potential and a second potential relative to a common background potential. The first and second images are developed by a first magnetic brush using two kinds of toners, at least one of which is magnetic, and both of which are chargeable to polarities opposite to each other with application to a developing electrode of a bias voltage capable of depositing the magnetic toner on the background potential area to deposit selectively the two toners on the first and second latent images and to deposit the magnetic toner on the background potential area, while collecting the deposited magnetic toner at least from the background potential area by second magnetic brush developing means.

Also mentioned are the following U.S. patents: U.S. Pat. No. 4,845,004 directed to hydrophobic silicon type micropowders comprising silicon type microparticles which have been treated with secondary tertiary amine functional silanes, and when the micropowders combine with the positively charging resin powder, such as a toner, the fluidity of the resin powder is substantially increased, see for example the Abstract of the Disclosure, column 1, beginning at line 60, and continuing on to column 4 and the working Examples; U.S. Pat. No. 4,758,491 directed to dry toner and developer compositions with good charge stability and minimization of toner image transfer defects, which composition comprises a major component of a normally solid fixable binder resin which is free of siloxane segments and is a minor component in a normally solid multiphase thermoplastic condensate polymer which contains a polyorgano siloxane block or graft segment, note specifically the use of a charge control agent in column 2, beginning at line 50, examples of charge control agents being detailed, for example, in column 4, beginning at line 23, including ammonium or phosphonium salts, and the like; U.S. Pat. No. 4,485,003 directed to a toner for developing electrostatic latent images characterized in that the toner comprises an aluminum compound of a hydroxy carboxylic acid which may be substituted with alkyl and/or arylalkyl, see for example column 2, beginning at line 29, and continuing on to column 5; and U.S. Pat. No. 4,855,208 directed to a toner for developing electrostatic latent images, which toner comprises an aluminum compound of an aromatic amino carboxylic acid as represented by the formula illustrated in the Abstract of the Disclosure, and also see column 2, beginning at line 26, and continuing on to column 7.

Other representative patents of interest with respect to formation of two-color images include U.S. Pat. Nos. 4,045,218 and 4,572,651.

The process of charging a photoresponsive imaging member to a single polarity and creating on it an image of at least three different levels of potential of the same polarity is described in U.S. Pat. No. 4,078,929, trilevel imaging, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area with the second and third areas functioning as image areas. The charge pattern is developed in a first step with positively charged toner particles of a first color an, in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the trilevel process for generating images is U.S. Pat. No. 4,686,163, the disclosure of which is totally incorporated herein by reference.

The photoresponsive imaging member can be negatively charged, positively charged, or both, and the latent image formed on the surface may be comprised of either a positive or a negative potential, or both. In one embodiment, the image comprises three distinct levels of potential, all being of the same polarity. The levels of potential can be well differentiated, such that they are separated by at least 100 volts, and preferably 200 volts or more. For example, a latent image on an imaging member can comprise areas of potential at −800, −400, and −100 volts. In addition, the levels of potential may comprise ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ depending upon the type of imaging member selected.

Moreover, illustrated in copending application U.S. Ser. No. 500,335/91, the disclosure of which is totally incorporated herein by reference, are developers, toners and imaging processes thereof. In an embodiment of the copending application, there is provided a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin particles, colored, other than black, pigment particles, and an aluminum complex charge enhancing additive; (4) subsequently developing the high areas of potential by conductive magnetic brush development with a developer comprising a second black developer comprised of carrier particles and a toner comprised of resin, black pigment, such as carbon black, and a charge enhancing additive; (5) transferring the developed two-color image to a suitable substrate; and (6) fixing the image thereto. In an embodiment of the aforementioned copending application, the first developer comprises, for example, a first toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers,.Pliolites ®, crosslinked styrene acrylates, crosslinked styrene methacrylates, and the like wherein the crosslinking component is, for example, divinyl benzene, and mixtures thereof; a first colored blue, especially PV Fast Blue TM pigment present in an effective amount of from, for example, about 1 to about 15 percent by weight, and preferably from about 5 to about 10 weight percent; an aluminum complex charge enhancing additive; and a second developer comprised of a second toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, Pliolites ® crosslinked styrene acrylates, crosslinked styrene methacrylates, and the like wherein the crosslinking component is, for example, divinyl benzene, and mixtures thereof; and a black pigment present in an effective amount of from, for example, about 1 to about 15 percent by weight, and preferably from about 1 to about 5 weight percent wherein the aforementioned black toner contains a charge enhancing additive such as an alkyl pyridinium halide, and preferably cetyl pyridinium chloride, and in an embodiment the black toner is comprised of 92 percent by weight of a styrene n-butyl methyacrylate copolymer (58/42), 6 percent by weight of Regal 330 ® carbon black, and 2 percent by weight of the charge enhancing additive cetyl pyridinium chloride.

Illustrated in copending application U.S. Ser. No. 547,362/91 (D/90099), the disclosure of which is totally incorporated herein by reference, is a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin, a positively charging pigment, and a negatively charging pigment; (4) subsequently developing the high areas of potential by conductive magnetic brush development with a developer comprising a second developer comprised of carrier particles and a toner comprised of resin, black pigment, such as carbon black, and a charge enhancing additive; (5) transferring the developed two-color image to a suitable substrate; and (6) fixing the image thereto.

SUMMARY OF THE INVENTION

It is a feature of the present invention to provide toner and developer compositions, and imaging processes thereof.

It is another feature of the present invention to provide imaging processes for obtaining two-color images, and discharge area development images, that is, for example, wherein the background areas of a negatively charged layered imaging member can be developed.

In another feature of the present invention there are provided passivated green toner compositions.

In still another feature of the present invention there are provided passivated colored toner pigments, thereby enabling toners with stable triboelectrical characteristics.

Another feature of the present invention is to provide a process for forming multi, especially two-color images wherein the first green developer does not discharge the latent image to be developed by the second developer.

Another feature of the present invention is to provide a two-color image formation process wherein the developers are of specified triboelectric charge, charge distribution, and conductivity, and exhibit acceptable admix times and developer lifetimes.

In another feature of the present invention there are provided passivated, especially green toner compositions.

In still another feature of the present invention there are provided passivated colored toner pigments, thereby enabling toners with stable triboelectrical characteristics.

Another feature of the present invention is to provide a process for forming two-color images wherein the first developer does not discharge the latent image to be developed by the second developer.

Another feature of the present invention is to provide a two-color image formation process wherein the developers are of specified triboelectric charge, charge distribution, and conductivity, and exhibit acceptable admix times and developer lifetimes.

Moreover, in another feature of the present invention there are provided colored, especially green toners and developers with different colors, which toners can be used interchangeably in, for example, electrostatic imaging apparatus.

In another feature of the present invention there are provided colored toners and developers with different colors, which toners can be used interchangeably with the same carrier for development, and wherein excellent quality images can be obtained in embodiments.

These and other features of the present invention are accomplished by providing developers, toners and imaging processes thereof. In an embodiment of the present invention, there are provided green toners and a process for the formation of passivated green toners which comprises admixing toner resin particles, colored green pigment particles, such as HELIOGEN GREEN K-9360 TM available from BASF, and thereafter blending therwith a positive charge enhancing additive, followed by the addition of known surface additives. Developers can be prepared by admixing the aforementioned toners with known carriers, such as steel, which is usually coated with a polymer, such as polymethylacrylate, and wherein the coating contains conductive particles, such as carbon black like VULCAN® carbon black available from Cabot Corporation.

In an embodiment of the present invention, a green passivated toner is prepared by blending together a green pigment that possesses a negative triboelectric charge with a positively charging charge additive in an effective ratio to achieve a toner with stable triboelectric characteristics and excellent admix properties as determined in a charge spectrograph against selected carrier particles, such as those comprised of steel, which is usually coated with a polymer, such as polymethylacrylate, and wherein the coating contains conductive particles, such as carbon black like VULCAN® carbon black available from Cabot Corporation. In an embodiment of the present invention, a green passivated toner which can be prepared by blending together in a suitable known vessel a green pigment with a negative tribo charge with a postively charging charge additive in such a ratio, such as 7:1, to achieve the desired admix as indicated herein, such as, for example, from about 15 to about 30 seconds, and stable toner tribo characteristics as indicated herein, and more specifically about −18 microcoulombs per gram with a specific carrier comprised, for example, of a steel core with a 1 weight percent coating of polymethylacrylate containing conductive particles, for example about 20 weight percent of carbon black. The toner components can be blended in a Lodige Blender, attrited, micronized, and classified to provide toner particles with an average particle volume diameter of from about 9 to about 20, and preferably from about 10 to about 15 microns, and in an embodiment there may be blended a certain green pigment as indicated herein with a positive charge or a negatively charging charge control additive such as an aluminum complex, as illustrated in U.S. Pat. No. 4,845,003, the disclosure of which is totally incorporated herein by reference, mentioned herein like BONTRON E-88 TM available from Orient Chemicals of Japan. In one embodiment, passivation was determined to be achieved since a toner with a green pigment and a positive charge control additive, and a blue toner with a negative charge control additive both had a −18 triboelectric charge, and about a 30 second admix rate against the aforementioned steel coated carrier.

The developers of the present invention can be selected for forming multi-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a passivated colored green toner as illustrated herein; (4) subsequently developing the high areas of potential by conductive magnetic brush development with a developer comprising a second developer comprised of carrier particles and a toner comprised of resin, black pigment, such as carbon black, and a charge enhancing additive; (5) transferring the developed two-color image to a suitable substrate; and (6) fixing the image thereto.

Examples of selected resin particles for the passivated green toners of the present invention include styrene acrylates, styrene methacrylates, polyesters, crosslinked styrene methacrylates, styrene butadienes, especially those with a high, such as from about 80 to about 95 weight percent, styrene content like the commercially available Goodyear PLIOLITES®, PLIOTONES®, and the like. The resin is present in an effective amount of from, for example, about 70 to about 98 percent by weight, which resin is a PLIOLITE®, preferably a styrene butadiene with from about 89 to about 92 weight percent of styrene. Typical toner resins include styrene butyl methacrylates, polyesters, styrene-butadiene polymers, particularly styrene-butadiene copolymers wherein the styrene is present in an amount of from about 83 to about 93 percent by weight, and preferably about 88 percent by weight, and the butadiene is present in an amount of from about 7 to about 17 percent by weight, and preferably about 12 percent by weight, such as resins commercially available as PLIOLITES® and PLIOTONES® from Goodyear Chemical. Also suitable are styrene-n-butylmethacrylate polymers, particularly those styrene-n-butylmethacrylate copolymers wherein the styrene segment is present in an amount of from about 50 to about 70 percent by weight, preferably about 58 percent by weight, and the n-butylmethacrylate portion is present in an amount of from about 30 to about 50 percent by weight, and preferably about 42 percent by weight. Mixtures of these resins may also be selected. Furthermore, suitable are styrene-n-butylmethacrylate polymers wherein the styrene portion is present in an amount of from about 50 to about 80 percent by weight, and preferably about 65 percent by weight, and the n-butylmethacrylate portion is present in an amount of from about 50 to about 20 percent by weight, and preferably about 35 percent by weight.

Examples of green pigments include HELIOGEN GREEN K-9360 TM, HELIOGEN GREEN K-8730 TM, FANAL GREEN D8330 TM and the like. Also, there may be selected in embodiments for the formation of the green pigment mixtures of other known pigments, such as NEOPEN BLUE NB802 TM, and PERMANENT YELLOW FGL TM, a mixture of PV FAST BLUE TM, PERMANENT YELLOW FGL TM and the like. The aforementioned green pigments are present in various effective amounts, such as, for example, from about 1 to about 15 weight percent, and preferably from about 5 to about 15 weight percent.

Charge enhancing additives, which are present in the toner in various effective amounts, such as from about 1 to about 20, and preferably from about 0.05 to about 3 weight percent include known additives such as distearyl dimethyl ammonium methyl sulfate, cetyl pyridinium halide, especially the chloride, bisulfides, and mixtures thereof. Examples of specific charge additives include alkyl pyridinium halides, and preferably cetyl pyridinium chloride, reference U.S. Pat. No. 4,298,672, the disclosure of which is totally incorporated herein by reference; organic sulfates and sulfonates, reference U.S. Pat. No. 4,338,390, the disclosure of which is totally incorporated herein by reference; distearyl dimethyl ammonium methyl sulfate (DDAMS), reference U.S. Pat. No. 4,560,635, the disclosure of which is totally incorporated herein by reference, and the like. The toner or toners with these additives usually possess a negative charge of from about 10 to about 45 microcoulombs per gram and preferably from about 5 to about 25 microcoulombs per gram, which charge is dependent on a number of known factors including the amount of charge enhancing additive present and the exact composition of the other compositions such as the toner resin, the pigment, the carrier core, and the coating selected for the carrier core, and an admix time of from about 15 to about 60 seconds and preferably from about less than 15 to about 30 seconds. In the preparation of the colored and toner compositions, normally the products obtained comprised of toner resin, pigment and charge enhancing additive can be subjected to micronization and classification, which classification is primarily for the purpose of removing undesirable fines and substantially very large particles to enable, for example, toner particles with an average volume diameter of from about 5 to about 25 microns and preferably from about 10 to about 20 microns. The aforementioned toners may include as surface or external components additives in an effective amount of, for example, from about 0.1 to about 3 weight percent, such as colloidal silicas, such as AEROSIL R 972®, metal salts, metal salts of fatty acids, especially zinc stearate, reference for example U.S. Pat. Nos. 3,590,000; 3,655,374; 3,900,588 and 3,983,045, the disclosures of which are totally incorporated herein by reference, metal oxides and the like for the primary purpose of controlling toner conductivity and powder flowability. Examples of specific external additives of colloidal silica, include Aerosil R972®, Aerosil R976®, Aerosil R812®, and the like, available from Degussa, and metal salts or metal salts of fatty acids, such as zinc stearate, magnesium stearate, aluminum stearate, cadmium stearate, and the like, may be blended on the surface of the colored toners. Toners with these additives blended on the surface are disclosed in the prior art such as U.S. Pat. Nos. 3,590,000; 3,720,617; 3,900,588 and 3,983,045, the disclosures of each of which are totally incorporated herein by reference. Generally, the silica is present in an amount of from about 0.1 to about 2 percent by weight, and preferably about 0.3 percent by weight of the toner, and the stearate is present in an amount of from about 0.1 to about 2 percent by weight, and preferably about 0.3 percent by weight, of the toner. Varying the amounts of these two external additives enables adjustment of the charge levels and conductivities of the toners. For example, increasing the amount of silica generally adjusts the triboelectric charge in a negative direction and improves admix times, which are a measure of the amount of time required for fresh toner to become triboelectrically charged after coming into contact with the carrier. In addition, increasing the amount of stearate improves admix times, renders the developer composition more conductive, adjusts the triboelectric charge in a positive direction, and improves humidity insensitivity.

The carrier for the colored developer in an embodiment of the present invention can be comprised of a steel core with an average diameter of from about 25 to about 225 microns and a coating thereover selected from the group consisting of methyl terpolymer, polymethyl methacrylate, and a blend of from about 35 to about 65 percent by weight of polymethyl methacrylate and from about 35 to about 65 percent by weight of chlorotrifluoroethylene-vinyl chloride copolymer wherein the coating contains from 0 to about 40 percent by weight of the coating conductive particles, such as carbon black, and wherein the coating weight is from about 0.2 to about 3 percent by weight of the carrier. The carrier for the black developer can be comprised of a steel core with an average diameter of from about 25 to about 225 microns and a coating thereover selected from the group consisting of chlorotrifluoroethylene-vinyl chloride copolymer containing from 0 to about 40 percent by weight of conductive particles and wherein the coating weight is from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier. Preferred carriers are generally conductive, and exhibit in an embodiment of the present invention a conductivity of, for example, from about $10^{-14}$ to about $10^{-6}$, and preferably from about $10^{-11}$ to about $10^{-7}$ (ohm-cm)$^{-1}$. Conductivity is generally controlled by the choice of carrier core and coating by partially coating the carrier core, or by coating the core with a coating containing carbon black the carrier is rendered conductive. In addition, irregularly shaped carrier particle surfaces and toner concentrations of from about 0.2 to about 5 will generally render a developer conductive. Addition of a surface additive such as zinc stearate to the surface of the toner particles can render a developer conductive with the level of conductivity rising with increased concentrations of the additive. Other carriers, including those with conductivities not specifically mentioned, may also be selected, including the carriers as illustrated in U.S. Pat. No. 4,883,736, the disclosure of which is totally incorporated herein by reference, and U.S. Pat. Nos. 4,937,166 and 4,935,326, the disclosures of which are totally incorporated herein by reference. The aforementioned carriers in one embodiment comprise a core with two polymer coatings not in close proximity in the triboelectric series.

More specifically, the carrier for the developers of the present invention generally comprises ferrite, iron or a steel core, preferably unoxidized, such as HoeganesAnchor Steel Grit, with an average diameter of from about 25 to about 215 microns, and preferably from about 50 to about 150 microns. Each of these carrier cores can be coated with a know polymer, such as a methyl terpolymer, reference for example U.S. Pat. Nos. 3,467,634 and 3,526,533, the disclosure of which is totally incorporated herein by reference, containing from 0 to about 40 percent by weight of conductive particles such as carbon black or other conductive particles as disclosed in U.S. Pat. No. 3,533,835, the disclosure of which is totally incorporated herein by reference, with the coating weight being from about 0.2 to about 3 percent by weight of the carrier, and preferably from about 0.4 to about 1.5 percent by weight of the carrier. Also, the carrier coating may comprise polymethyl methacrylate containing conductive particles in an amount of from 0 to about 40 percent by weight of the polymethyl methacrylate, and preferably from about 10 to about 20 percent by weight of the polymethyl methacrylate, wherein the coating weight is from about 0.2 to about 3 percent by weight of the carrier and preferably about 0.8 percent by weight of the carrier. Another carrier coating for the carrier of the colored developer comprises a blend of from about 35 to about 65 percent by weight of polymethyl methacrylate and from about 35 to about 65 percent by weight of chlorotrifluoroethylenevinyl chloride copolymer, commercially available as OXY 461® from Occidental Petroleum Company and containing conductive particles in an amount of from 0 to about 40 percent by weight, and preferably from about 20 to about 30 percent by weight, wherein the coating weight is from about 0.2 to about 3 percent by weight of the carrier, and preferably about 1 percent by weight of the carrier.

Excellent solid area development, and excellent line copy development are obtained when the aforementioned carriers are selected in embodiments of the present invention. Also, the developer possesses stable electrical characteristics for extended time periods of up to six months.

The tiboelectric charge of the colored toners can vary depending on the developer components, for example; generally, however, the tribo as determined by the known charge spectrograph is from about 10 to about 30, and preferably from about 15 to about 20 microcoulombs per gram; and the admix time of uncharged freshly added toner is from about 15 to about 60, and preferably about 30 seconds as determined by the known charge spectrograph.

By passivation in embodiments is meant minimizing, or avoiding any adverse effects on the toner tribo charge by the pigment.

Examples of imaging members selected for the processes of the present invention may be of any type capable of maintaining three distinct levels of potential. Generally, various dielectric or photoconductive insulating material suitable for use in xerographic, ionographic, or other electrophotographic processes may be used, such as amorphous silicon, layered organic materials as disclosed in U.S. Pat. No. 4,265,990, the disclosure of which is totally incorporated herein by reference, and the like.

The photoresponsive imaging member can be negatively charged, positively charged, or both, and the latent image formed on the surface may be comprised of either a positive or a negative potential, or both. In one embodiment, the image comprises three distinct levels of potential, all being of the same polarity. The levels of potential should be well differentiated, such that they are separated by at least 100 volts, and preferably 200 volts or more. For example, a latent image on an imaging member can be comprised of areas of potential at −800, −400, and −100 volts. In addition, the levels of potential may comprise ranges of potential. For example, a latent image may comprise a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ depending upon the type of imaging member selected.

The latent image comprising three levels of potential, hereinafter referred to as a trilevel image, may be formed on the imaging member by any of various suitable methods, such as those illustrated in U.S. Pat. No. 4,078,929, the disclosure of which is totally incorporated herein by reference. For example, a trilevel charge pattern may be formed on the imaging member by the xerographic method by first uniformly charging the imaging member in the dark to a single polarity, followed by exposing the member to an original having areas both lighter and darker than the background area, such as a piece of gray paper having both white and black images thereon. In an embodiment, a trilevel charge pattern may be formed by means of a raster output scanner, optically modulating laser light as it scans a uniformly charged photoconductive imaging member. In this embodiment, the areas of high potential are formed by turning the light source off; the areas of intermediate potential are formed by exposing the imaging member to the light source at partial power; and the areas of low potential are formed by exposing the imaging member to the light source at full power.

Generally, in the process of the present invention the highlighted areas of the image are developed with a developer comprised of the green passivated toner, while the remaining portions of the image are developed with the black developer illustrated herein, and comprised, for example, of resin particles, black pigment particles, such as carbon black like REGAL 330® carbon black, wherein the carrier for the green toner is comprised of, for example, a Hoeganes steel core coated with 1 weight percent of polymethacrylate containing 20 weight percent of conductive carbon black particles, and the carrier for the black toner is comprised of a Hoeganes steel core coated with 0.4 weight percent of polymer comprised of 80 weight percent of OXY 461®, and 20 weight percent of conductive carbon black particles. In general, the highlighted color portions are developed first to minimize the interaction between the two developers, thereby maintaining the high quality of the black image.

Development is generally accomplished by the magnetic brush development process disclosed in U.S. Pat. No. 2,874,063, the disclosure of which is totally incorporated herein by reference. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. For the process of the present invention, the conductive magnetic brush process is generally preferred wherein the developer comprises conductive carrier particles and is capable of conducting an electric field between the biased magnet through the carrier particles to the photoreceptor. Conductive magnetic brush development is generally employed for the process of the present invention in view of the relatively small development potentials of around 200 volts that are generally available for the process; conductive development ensures that sufficient toner is presented on the photoreceptor under these development potentials to result in acceptable image density. Conductive development is also preferred to ensure that fringe fields occurring around the edges of images of one color are not developed by the toner of the other color.

During the development process, the developer housings can be biased to a voltage between the level of potential being developed and the intermediate level of charge on the imaging member. For example, if the latent image comprises a high level of potential of about −800 volts, an intermediate level of potential of about −400 volts, and a low level of about −100 volts, the developer housing containing the colored passivated positively charged toner that develops the high areas of potential may be biased to about −500 volts and the developer housing containing the negatively charged toner that develops the low areas of potential may be biased to about −300 volts. These biases result in a development potential of about −200 volts for the high areas of potential, which will be developed with a positively charged toner, and a development potential of about +200 volts for the low areas of potential, which will be developed with a negatively charged toner. Background deposits are suppressed by keeping the background intermediate voltage between the bias on the color developer housing and the bias on the black developer housing. Generally, it is preferred to bias the housing containing the positive toner to a voltage of from about 100 to about 150 volts above the intermediate level of potential and to bias the housing containing the negative toner to a voltage of from about 100 to about 150 volts below the intermediate level of potential, although these values may be outside these ranges.

The developed image is then transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

For the black developers comprised of a positively charged toner with a pigment such as carbon black, which developers can be comprised of similar components as the aforementioned colored green developers, with the exceptions that a black instead of green pigment is selected. The charge enhancing additive is, for example, an alkyl pyridinium chloride, and preferably cetyl pyridinium chloride, which is present in an effective amount of, for example, from about 0.1 to about 10 weight percent, and preferably from about 1 to about 5 weight percent, are usually selected for the development of the high potentials. Examples of black developers suitable for the process of the present invention comprise a toner and a carrier. The carrier comprises in an embodiment of the present invention ferrite, steel or a steel core, such as Hoeganes Anchor Steel Grit, with an average diameter of from about 25 to about 215 microns, and preferably from about 50 to about 150 microns, with a coating of chlorotrifluoroethylene-vinyl chloride copolymer, commercially available as OXY 461® from Occidental Petroleum Company, which coating contains from 0 to about 40 percent by weight of conductive particles homogeneously dispersed in the coating at a coating weight of from about 0.4 to about 1.5 percent by weight. This coating can be solution coated onto the carrier core from a suitable solvent, such as methyl ethyl ketone or toluene. Alternatively, the carrier coating may comprise a coating of polyvinyl fluoride, commercially available as Tedlar® from E.I. DuPont de Nemours and Company, present in a coating weight of from about 0.01 to about 0.2, and preferably about 0.05, percent by weight of the carrier. The polyvinyl fluoride coating is generally coated onto the core by a powder coating process wherein the carrier core is coated with the polyvinyl fluoride in powder form and subsequently heated to fuse the coating. In one embodiment, the carrier comprises an unoxidized steel core which is blended with polyvinyl fluoride (Tedlar®), wherein the polyvinyl fluoride is present in an amount of about 0.05 percent by weight of the core. This mixture is then heat treated in a kiln at about 400° F. to fuse the polyvinyl fluoride coating to the core. The resulting carrier exhibits a conductivity of about $7.6\times10^{-10}$(ohm-cm)$^{-1}$. Optionally, an additional coating of polyvinylidene fluoride, commercially available as Kynar® from Pennwalt Corporation, may be powder coated on top of the first coating of the carrier in the black developer at a coating weight of from about 0.01 to about 0.2 percent by weight. The carrier for the black developer generally has a conductivity of from about $10^{-14}$ to about $10^{-7}$, and preferably from about $10^{-12}$ to about $10^{-9}$ (ohm-cm)$^{-1}$.

Developer compositions selected for the processes of the present invention generally comprise various effective amounts of carrier and toner. Generally, from about 0.5 to about 5 percent by weight of toner and from about 95 to about 99.5 percent by weight of carrier are admixed to formulate the developer. The ratio of toner to carrier may vary depending, for example, on the tribo charge and the like desired. For example, an imaging apparatus employed for the process of the present invention may be replenished with a colored developer comprising about 55 percent by weight of toner and about 45 percent by weight of carrier.

The black positively charged toners of the present invention may also optionally contain as an external additive a linear polymeric alcohol comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is a number of from about 30 to about 300, and preferably from about 30 to about 50, reference U.S. Pat. No. 4,883,736, the disclosure of which is totally incorporated herein by reference. Linear polymeric alcohols of this type are generally available from Petrolite Chemical Company as Unilin®. The linear polymeric alcohol is generally present in an amount of from about 0.1 to about 1 percent by weight of the toner.

Black developer compositions for the present invention comprise in an embodiment from about 1 to about 5 percent by weight of the toner and from about 95 to about 99 percent by weight of the carrier. The ratio of toner to carrier may vary. For example, an imaging apparatus employed for the process of the present invention may be replenished with a colored developer comprising about 65 percent by weight of toner and about 35 percent by weight of carrier. The triboelectric charge of the black toners generally is from about −10 to about −30, and preferably from about −13 to about −18 microcoulombs per gram, although the value may be outside of this range. Particle size of the black toners is generally from about 8 to about 13 microns in volume average diameter, and preferably about 11 microns in volume average diameter, although the value may be outside of this range, provided that the objectives of the present invention are achieved.

Coating of the carrier particles of the present invention may be by various suitable process, such as powder coating, wherein a dry powder of the coating material is applied to the surface of the carrier particle and fused to the core by means of heat; solution coating, wherein the coating material is dissolved in a solvent and the resulting solution is applied to the carrier surface by tumbling, or fluid bed coating in which the carrier particles are blown into the air by means of an air stream; and an atomized solution comprising the coating material and a solvent is sprayed onto the airborne carrier particles repeatedly until the desired coating weight, from about 1 to about 5, and preferably from about 1 to about 3 weight percent, is achieved.

The toners of the present invention may be prepared by processes as indicated herein to achieve passivation such as extrusion, which is a continuous process that entails dry blending the resin, pigment, and charge control additive, placing them into an extruder, melting and mixing the mixture, extruding the material, and reducing the extruded material to pellet form. The pellets are further reduced in size by grinding or jetting, and are then classified by particle size. In an embodiment of the present invention, toner compositions with an average particle size of from about 10 to about 25, and preferably from 10 to about 15 microns are preferred. External additives such as linear polymeric alcohols, silica, or zinc stearate are then blended with the classified toner in a powder blender. Subsequent admixing of the toners with the carriers, generally in amounts of from about 0.5 to about 5 percent by weight of the toner and from about 95 to about 99.5 percent by weight of the carrier, yields the developers of the present invention.

Also, the toners and developers of the present invention can be utilized in other color imaging processes, such as process color, and the like. One development process comprises a developer housing with a twin auger transport single magnetic brush design mounted in the approximate 6 o'clock orientation. The magnetic brush roll (developer roll) is about 30 millimeters in diameter, sandblasted for roughness, and preferably operates at about 1.5 times the speed of the photoreceptor (P/R), or imaging member. The developer roll is spaced about 0.5 millimeter from the photorecptor and is biased with a square wave 550 volts RMS 2.0 KHz AC bias added to the DC bias which is variable between 0 and −500 volts depending upon the photoreceptor discharge characteristics, and the desired xerographic developability established by the control algorithm. A stationary magnet is situated internal to the rotating developer roll sleeve, and is comprised of a ferrite with a designed magnetic pole configuration to satisfy the requirements of controlling the developer transport and developability. The developer flow (termed Mass on the Sleeve, or MOS) can be controlled by the location of a low permeability trimmer bar in the magnetic field at the point of trimming. Typically, the MOS is set at $33\pm3$ mg/cm$^2$ and is sensitive to the trim gap, toner concentration (TC) and developer tribo, hence, the developer housing has a toner concentration sensor as part of the process control circuitry. The twin augers in the developer housing sump transport the developer in opposite directions, first past the toner dispenser, then to the developer pick up region of the developer roll. The augers have slits built into them in order to facilitate the mixing of the fresh toner added to the developer. Usually a number of latent images are formed and developed sequentially on the imaging member with the appropriate toner of the present invention, depending on the color desired for example.

The disclosure of all the United States patents and pending applications mentioned herein are each totally incorporated herein by reference.

The following examples are provided. All parts and percentages are by weight unless otherwise indicated.

EXAMPLE I

A black developer composition was prepared as follows. Ninety-two (92) parts by weight of a styrene-n-butylmethacrylate resin, 6 parts by weight of Regal 330® carbon black obtained from Cabot Corporation, and 2 parts by weight of the charge additive cetyl pyridinum chloride were melt blended in an extruder wherein the die was maintained at a temperature of between 130° and 145° C. and the barrel temperature ranged from about 80° to about 100° C., followed by micronization and air classification to yield toner particles of a size of 12 microns in volume average diameter. Subsequently, carrier particles were prepared by solution coating a Hoeganes Anchor Steel core with a particle diameter range of from about 75 to about 150 microns, available from Hoeganes Company, with 0.4 parts by weight of a coating comprising 20 parts by weight of VULCAN® carbon black, available from Cabot Corporation, homogeneously dispersed in 80 parts by weight of a chlorotrifluoroethylene-vinyl chloride copolymer, commercially available as OXY 461® from Occidental Petroleum Company, which coating was solution coated from a methyl ethyl ketone solvent. The black developer was then prepared by blending 97.5 parts by weight of the coated carrier particles with 2.5 parts by weight of the toner in a Lodige Blender for about 10 minutes resulting in a developer with a toner exhibiting a triboelectric charge of +18 microcoulombs per gram as determined in the known Faraday Cage apparatus and a carrier conductivity of $6.6\times10^{-10}$ (ohm-cm)$^{-1}$. Admix time for substantially uncharged added toner comprised of the same components of the above prepared toner was less than 30 seconds as determined in the known spectrograph.

EXAMPLE II

A green developer composition was prepared as follows. Ninety two (92) percent by weight of styrene butadiene (89/11), 7 percent of the pigment, HELIOGEN GREEN K 9360 TM, obtained from BASF, and 1 percent by weight of the positive charge additive distearyl dimethyl ammonium methyl sulfate, which additive serves to passivate the green pigment to a desired triboelectric charge and a certain admix as indicated herein, were melt blended in an extruder wherein the die was maintained at a temperature of between 130° and 145° C. and the barrel temperature ranged from about 80° to about 100° C., followed by micronization and air classification to yield toner particles of a size of 11.5 microns in volume average diameter. The toner particles were then blended with 0.3 percent by weight of Aerosil R972® and 0.3 percent by weight of zinc stearate onto the surface of the toner in a Lodige blender. Subsequently, carrier particles were prepared by solution coating a Hoeganes Anchor Steel core with a particle diameter range of from about 75 to about 150 microns, available from Hoeganes Company, with 0.8 parts by weight of a coating comprising 20 parts by weight of VULCAN® carbon black, available from Cabot Corporation, homogeneously dispersed in 80 parts by weight of polymethyl methacrylate, which coating was solution coated from a toluene solvent. A green developer was then prepared by blending 97.5 parts by weight of the coated carrier particles with 2.5 parts by weight of the above green toner in a Lodige Blender for about 10 minutes resulting in a developer with a toner exhibiting a triboelectric charge of −18 microcoulombs per gram as determined in the known Faraday Cage apparatus and a carrier conductivity of $1.5\times10^{-10}$ $(\text{ohm-cm})^{-1}$. Admix time for substantially uncharged added green toner comprised of the same components of the above prepared toner was less than 30 seconds as determined in the known spectrograph.

The above green developer, and the black developer of Example I, were then incorporated into an imaging device equipped to generate and develop trilevel images according to the method of U.S. Pat. No. 4,078,929, the disclosure of which is totally incorporated herein by reference. A trilevel latent image was formed on the imaging member and the low areas of −100 volts potential were developed with the green developer, followed by development of the high areas of −750 volts potential with the black developer, subsequent transfer of the two-color image to paper, and heat fusing of the image to the paper. Images formed exhibited excellent copy quality with substantially no background for 400,000 imaging cycles. Also, the aforementioned toners exhibited stable triboelectric charging characteristics, that is the triboelectric charging properties remain relatively constant for 400,000 imaging cycles at relative humidities of from 20 to about 80 percent and at temperatures of from about 25° C. to about 70° C. at which time the test was terminated.

Various effective amounts of first developer and second developer can be selected for the process of the present invention including, for example, from about 10 to about 90 percent of the first developer and from about 90 to about 10 percent of the second developer, and preferably in an embodiment of the present invention from about 40 to 60 percent of the first colored developer and 60 to 40 percent by weight of the second black developer. Other amounts not specifically mentioned herein can be selected depending, for example, on a number of factors including the specific components selected for the toner and developer, and the like.

EXAMPLE III

A passivated toner and developer can, it is believed, be prepared by repeating the process of Example II with the exception that the green pigment selected is HELIOGEN GREEN K8730 TM (BASF). Substantially similar results are obtained. The toner tribo is a negative −19 microcoulombs per gram.

EXAMPLE IV

A passivated toner and developer can, it is believed, be prepared by repeating the process of Example II with the exception that the green pigment selected is comprised of a mixture of 3.75 weight percent of NEOPEN BLUE NB802 TM (BASF) and 5 weight percent of PERMANENT YELLOW FGL TM (American Hoechst), and 1.5 percent by weight of the sulfate charge additive, the amount of all toner components being equal to 100 percent in all the Examples. Substantially similar results are obtained. The toner tribo is a negative −19 microcoulombs per gram.

EXAMPLE V

A passivated toner and developer can, it is believed, be prepared by repeating the process of Example II with the exception that the green pigment selected is comprised of a mixture of 1.5 weight percent of PV FAST BLUE B2GA TM (American Hoechst), and 5 weight percent of PERMANENT YELLOW FGL TM (American Hoechst). Substantially similar results are obtained. The toner tribo is a negative −16 microcoulombs per gram. All tribos and admix times reported can be determined by a charge spectrograph.

EXAMPLE VI

A passivated toner and developer can, it is believed, be prepared by repeating the process of Example II with the exception that the green pigment selected is comprised of a mixture of 4 weight percent of FANAL GREEN D8330 TM (BASF) as the pigment, and 3 weight percent of BONTRON E-88 TM, an aluminum complex available from Orient Chemicals of Japan, as the negative charge control additive. The amount of all toner components is equal to 100 percent in all the Examples. Substantially similar results are obtained. The toner tribo is a negative −17 microcoulombs per gram.

EXAMPLE VII

A passivated toner and developer can, it is believed, be prepared by repeating the process of Example II, with the exception that the green pigment selected is comprised of a mixture of 4 weight percent of FANAL GREEN D8330 TM (BASF) as the positive charging pigment, and 3 weight percent of BONTRON E-84 TM, a zinc complex available from Orient Chemicals of Japan as the negative charge control additive. Substantially similar results are obtained. The toner tribo is a negative −18 microcoulombs per gram.

HELIOGEN GREEN K 9360 TM is a specific halogenated copper phthalocyanine; HELIOGEN GREEN K 8730 TM is a specific halogenated copper phthalocyanine; NEOPEN BLUE NB802 TM is believed to be a specific substituted copper phthalocyanine; PERMANENT YELLOW FGL TM is believed to be a specific monazo dye; FANAL GREEN D8330 TM is a specific triarylmethane salt; and PV FAST BLUE B 2GA TM is believed to be a specific copper phthalocyanine.

Also disclosed is the admixing in known effective amounts of known cyan, magenta, and yellow toners, preferably with a common carrier comprised, for example, of steel coated with polymethyl methacrylate and containing conductive carbon black particles, such as 20 weight percent of VULCAN TM carbon black, to obtain process colors like red, blue, green, and the like; for example yellow and magenta will provide a green toner.

Other embodiments and modifications of the present invention may occur to those skilled in the art subsequent to a review of the present application; these embodiments and modifications, as well as equivalents thereof, are also included within the scope of this invention.

What is claimed is:

1. A negatively charged green toner composition comprised of resin particles, HELIOGEN GREEN TM pigment particles, a positively charging charge enhancing additive and surface additives wherein the charge enhancing additive is distearyl dimethyl ammonium methyl sulfate incorporated into said toner composition that enables passivation of said green pigment particles and wherein said passivated green pigments enable the minimization or avoidance of adverse effects on the toner triboelectric charging characteristics and said toner composition has rapid admix characteristics with an admix time of from about 15 to about 60 seconds.

2. A toner in accordance with claim 1 wherein the resin is comprised of a styrene butadiene.

3. A toner in accordance with claim 1 wherein the resin is comprised of a styrene acrylate, or a styrene methacrylate.

4. A toner in accordance with claim 1 wherein the surface additives are comprised of colloidal silicas.

5. A toner in accordance with claim 1 wherein the surface additives are comprised of metal salts of fatty acids.

6. A developer composition comprised of the toner of claim 1 and carrier particles.

7. A developer in accordance with claim 6 wherein the carrier is comprised of a core with a polymeric coating thereover.

8. A developer in accordance with claim 7 wherein the coating is comprised of a terpolymer of styrene, methacrylate, and an organic siloxane.

* * * * *